United States Patent [19]

Ishitani

[11] 4,425,859

[45] Jan. 17, 1984

[54] ZIG ZAG SEWING MACHINE

[75] Inventor: Eiichi Ishitani, Kasugai, Japan

[73] Assignee: Brother Kogyo Kabushiki Kaisha, Nagoya, Japan

[21] Appl. No.: 244,006

[22] Filed: Mar. 16, 1981

[30] Foreign Application Priority Data

Apr. 11, 1980 [JP] Japan ..... 55-48464

[51] Int. Cl.[3] ..... D05B 3/06

[52] U.S. Cl. ..... 112/158 R; 112/73

[58] Field of Search ..... 112/158 R, 182, 228, 112/158 B, 73

[56] References Cited

U.S. PATENT DOCUMENTS

| | | | |
|---|---|---|---|
| 1,830,126 | 11/1931 | Myers | 112/158 R |
| 3,082,722 | 3/1963 | Tateishi | 112/158 R X |
| 3,476,066 | 11/1969 | Szuba et al. | 112/158 R |

FOREIGN PATENT DOCUMENTS

| | | | |
|---|---|---|---|
| 533304 | 9/1955 | Italy | 112/158 R |
| 638652 | 12/1978 | U.S.S.R. | 112/158 B |

*Primary Examiner*—Andrew M. Falik

*Attorney, Agent, or Firm*—Leydig, Voit, Osann, Mayer & Holt, Ltd.

[57] ABSTRACT

In a zig zag sewing machine, an arm shaft is rotatably supported on an arm thereof and carries at one end a handwheel member. The arm shaft performs a clockwise rotation simultaneous with the clockwise rotation of the handwheel member end. Due to such rotation of the arm shaft, a needle bar is given a reciprocating motion, and also a lateral movement in a plane perpendicular to the axis of the arm shaft. A bed shaft is rotatably supported on a bed parallel to the arm shaft and extending from a position corresponding to the reciprocating path of the needle, in the opposite direction from the arm shaft. A loop taker having a thread seizing rotary hook is mounted to the bed shaft at the corresponding position and rotated synchronously with and in an opposite direction to the rotation of the arm shaft. The thread seizing rotary hook of the loop taker and the bed shaft are positioned on opposite sides of the reciprocating path of the needle.

5 Claims, 12 Drawing Figures

R1
R2
L1
L2
L3
ℓ1
ℓ2
ℓ3
θ1
θ2
θ3
β1
β2
α
26
19
30
42a

ZIG ZAG SEWING MACHINE

FIELD OF THE INVENTION

This invention relates to a zig zag sewing machine and more particularly to a zig zag sewing machine wherein zig zag stitches are formed through cooperation between a needle and a loop taker.

BACKGROUND OF THE INVENTION

In the prior art zig zag sewing machines such as the industrial lock stitch buttonhole sewing machine shown in the Patent No. 961,936 of the Federal Republic of Germany, an arm shaft is rotatably mounted on an arm of a machine frame and carries a handwheel member at one end portion. The arm shaft performs a clockwise rotation as seen from the handwheel member end. Due to such rotation of the arm shaft, a reciprocating motion is applied to a needle bar. Also a lateral movement in a plane perpendicular to the axis of the arm shaft is applied to the needle bar.

A bed shaft is mounted on a bed of the machine frame parallel with said arm shaft and extending from a position corresponding to the reciprocating path of the needle towards the same side as said arm shaft. A loop taker having a thread seizing rotary hook is mounted to the bed shaft adjacent the needle path. As shown in FIG. 1*a*, said loop taker is rotated synchronously with and in the same direction as said arm shaft in the ratio of 2:1 for each revolution of the arm shaft, with the thread seizing rotary hook of said loop taker being positioned on the opposite side of said bed shaft in regard to the reciprocating path of said needle.

This type of loop taker has been used for a long time in industrial lock stitch buttonhole sewing machines or high speed zig zag sewing machines. For construction reasons, the thread seizing rotary hook of the loop taker has been positioned on the opposite side of the bed shaft in regard to the reciprocating path of the needle, so that the upper and lower threads are arranged on the same side of the needle and the stitches are necessarily formed to perfect stitches. Lock stitches may be classified into perfect stitches and hitch stitches, of which the former stitches are preferred by many because of their excellent appearance and possibility of ornamental stitching.

However, in this type of sewing machine, the upward movement of the needle and the encounter distance of the loop taker and the needle may be changed considerably depending on whether the needle bar is raised while it is at the center of the oscillation amplitude (FIG. 1*b*) or while it is at the left hand portion of the oscillation amplitude (FIGS. 2*b* and 3). Said upward movement of the needle is construed as meaning the upward movement wherein the needle vertically moves from the lowest portion to the position at which the thread seizing rotary hook encounters the center line of the needle, and said encounter distance is considered as meaning the distance between the thread seizing rotary hook of the loop taker and the top end of a thread aperture of the needle at which the thread seizing rotary hook encounters the center line of the needle.

Hence it is not possible to provide uniform stitches without skipped stitches and with the predetermined encounter distance in each point of the oscillation amplitude of the needle bar.

For instance, as shown in FIG. 1*a*, with the radius R1 of the locus of rotation of a crank pin mounted on a crank member being equal to 17.5 mm, the radius R2 of the locus of rotation of the rotary hook of the loop taker being equal to 20.9 mm, the distance L1 between the axes of rotation of the arm shaft and the loop taker being equal to 196.5 mm, the distance L2 between the upper and lower pivot axes of a crank rod being equal to 45 mm and the distance L3 between the lower pivot axis of the crank rod and the upper end of the thread aperature of the needle being equal to 117.6 mm, the distance l1 between the upper end of the thread aperture and the locus of rotation of the thread seizing rotary hook is equal to 4.5 mm when the needle has reached its lower dead point with the needle bar being then at the center of the oscillation amplitude (FIG. 1*a*). Assuming that this sewing machine is so designed that the rotary hook encounters the needle with an encounter distance l2 of 2 mm when the needle has been raised 2.5 mm, with the arm shaft being swung through an angle $\theta 1$ equivalent to around 26.38°, the upward movement of the needle from the lower dead point and the encounter distance as obtained when the needle bar is swung towards left or right with amplitude l3 equal to 3 mm, as shown in FIGS. 2*a*, 2*b* and 3, are as shown in Table 1 below.

TABLE 1

| | Needle Bar Position | | |
|---|---|---|---|
| | Left Hand | Center | Right Hand |
| Upward Movement Magnitude (mm) | 1.38 | 2.5 | 3.92 |
| Encounter distance (mm) | 2.83 | 2.0 | 0.92 |

When the needle bar is raised while it is at the left hand position of the oscillational amplitude as shown in FIGS. 2*a* and 2*b*, the needle is displaced 3 mm to the left of the central position and hence the thread seizing rotary hook of the loop taker encounters the needle when the arm shaft has rotated through an angle $\theta$ 2 which is smaller than said angle $\theta$ 1 and is equal to $\theta$ 1 less a/2, i.e., equal to about 22.26°. Thus, the upward movement of the needle is reduced by 1.12 mm and the encounter distance l2 increased by 0.83 mm as compared to the case of FIG. 1*b* wherein the needle bar is raised while it is at the center position. The angle a is the angle that the line connecting the pivot or rotational axes of the arm shaft and loop taker makes with the line connecting the rotational axis of the loop taker and the extremity of the thread seizing rotary hook. When the loop taker is rotated through this angle a, the arm shaft is rotated through a half angle, i.e., a/2.

On the other hand, when the needle bar is raised while it is towards the right hand side of the oscillation amplitude, the needle is displaced 3 mm towards the right and hence the rotary hook encounters the needle when the arm shaft has rotated through $\theta$ 3 which is larger than $\theta$ 1 and is equal to $\theta$ 1 plus a/2, or about 30.51°. Thus, the upward movement of the needle is increased by 1.42 mm and the encounter distance is reduced by 1.71 mm as compared to the case of FIG. 1*b* wherein the needle bar is raised while it is at the center position. Thus, towards the left and right hand sides of the oscillation amplitude, the upper thread loop carried by the needle is not seized satisfactorily by the thread seizing rotary hook, thus resulting in stitch skipping or other stitching defects.

In addition, in this type of prior art sewing machine, the threading operation through the needle must be performed from the side of the needle through which the arm shaft and the bed shaft extend, i.e., from the rear side of the needle, due to the mechanical disposition of the loop taker. This is a laborious threading operation.

In order to overcome such defect, in a further prior art industrial lock stitch buttonhole sewing machine, the arm shaft is arranged to rotate counterclockwise when looking from the handwheel member end. In this case, since the rotational directions of the arm shaft and the loop taker are opposite to each other, the state of encounter of the thread seizing rotary hook of the loop taker with the needle may be improved at the left and right hand portions of the lateral needle motion, as will be appreciated from the subsequent description of FIGS. 4 and 5.

However, such arrangement has given rise to a further problem. Since the rotational direction of the arm shaft is now reversed, if it is desired to use the conventional link type thread take up mechanism without any design change, the disposition of the link type thread take up mechanism as viewed from the handwheel member end of the arm shaft must be reversed. This means that the thread aperture of the thread take up lever is positioned towards the left when looking from the handwheel member end of the arm shaft. This gives rise to serious problems since most users are right handed and the threading operation through the thread aperture of the thread take up lever becomes difficult if the thread aperture is positioned towards the left. In addition, the problem associated with threading through the needle still remains.

The thread take up lever may be arranged towards the right by using, for instance, a cam type thread take up mechanism. However, the cam type thread take up mechanism is not suitable for high speed stitching and is rather noisy in operation, whereas the conventional link type thread take up mechanism lends itself to high speed stitching and moreover is not noisy in operation.

In order to overcome these difficulties associated with the thread take up mechanism, the present inventors have devised, in a sewing machine in which the arm shaft is rotated counterclockwise when viewed from the handwheel member end, an improved lock type thread take up mechanism in which a link member has been added and in which the thread aperture of the thread take up lever is provided towards the right when viewed from said handwheel member end. However, such arrangement still has a disadvantage since the addition of the link member lowers the durability of the thread take up mechanism under high speed operation and deteriorates the thread volume curve although the threading operation through the thread take up lever may thereby be facilitated. Moreover, the aforesaid problem concerned with threading the needle may not be solved by this arrangement.

In view of the foregoing, the present invention provides a solution to all these problems inherent in the prior art.

SUMMARY OF THE INVENTION

Accordingly, it is the principal object of the present invention to provide a zig zag sewing machine devoid of the various inconveniences mentioned above and in which the bed shaft is arranged parallel to the arm shaft so as to extend to an opposite side of said arm shaft in regard to a position corresponding to said reciprocating path of the needle, and the loop taker is secured to said corresponding position of said bed shaft and rotated synchronously with and in an opposite direction to the rotation of said arm shaft.

It is another object of the present invention to provide a zig zag sewing machine wherein the state of encounter of the thread seizing rotary hook of the loop taker with the needle may be optimum even in the case where the needle is being raised while it is swung towards the left or right.

It is a further object of the present invention to provide a zig zag sewing machine wherein the conventional link type thread take up mechanism may be employed with the possibility of facilitating threading through the thread take up mechanism, improving durability under high speed operation, and providing an ideal thread volume curve. This can be attained through a system in which it is not the rotational direction of the arm shaft but that of the loop taker that has been changed.

It is a further object of the present invention to provide a zig zag sewing machine wherein the threading operation through the needle may be performed from the handwheel member side of the arm shaft and hence greatly facilitated through the above-mentioned arrangement of the bed shaft and the loop taker.

It is a further object of the present invention to provide a zig zag sewing machine wherein the stitches may always be the nice and attractive perfect stitches through use of the above-mentioned loop taker.

It is a further object of the present invention to provide a zig zag sewing machine which permits the conventional link type thread take up mechanism to be employed and may thus be suitable for high speed operation.

It is a still further object of the present invention to provide a zig zag sewing machine which permits these various results to be attained only by specific arrangement of the loop taker and which may be free from any disadvantages such as increased manufacturing costs.

Figures 1A, 1B, 2A, 2B, 3, 4, 5:
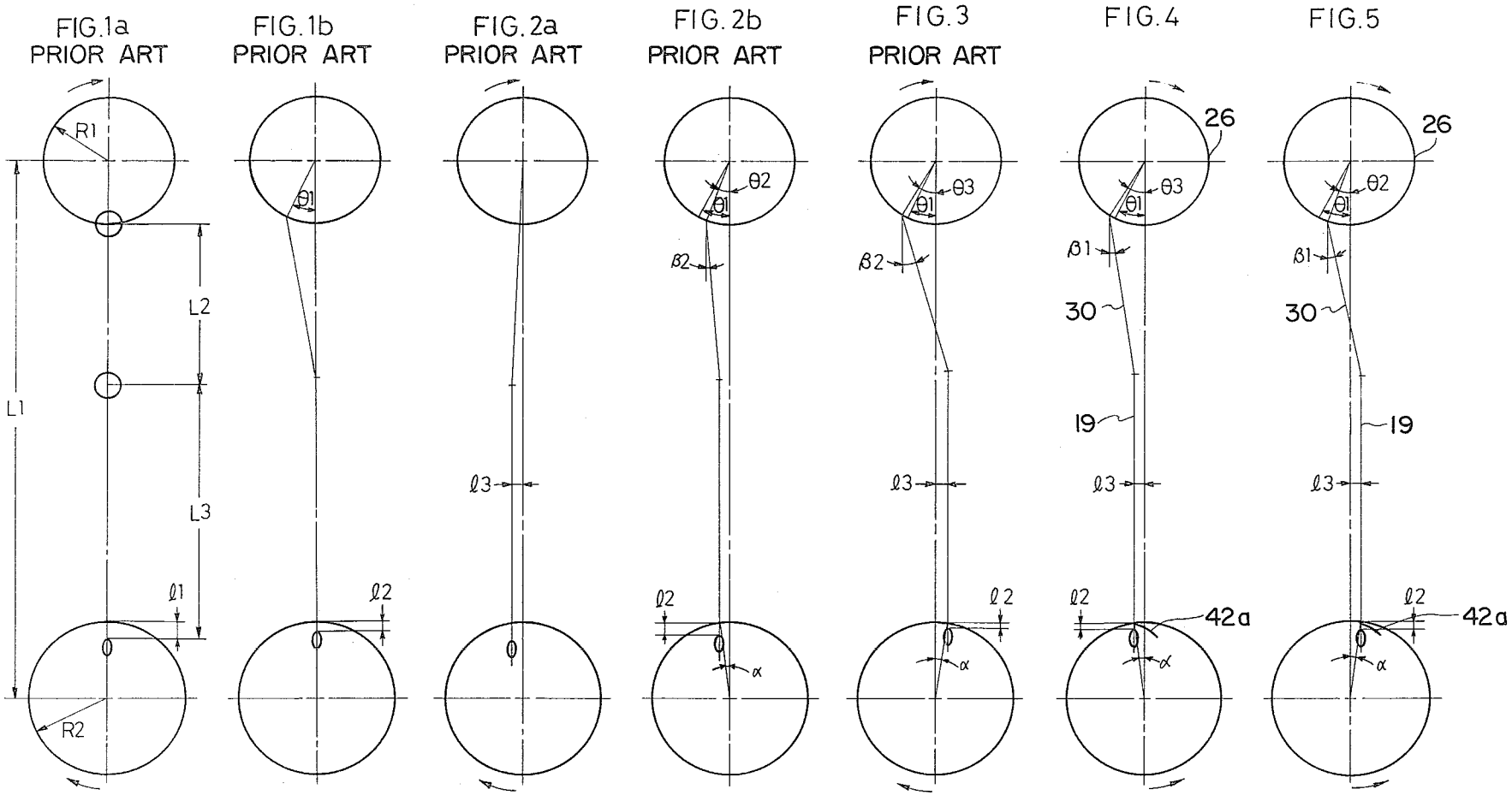
FIG.1a PRIOR ART
FIG.1b PRIOR ART
FIG.2a PRIOR ART
FIG.2b PRIOR ART
FIG.3 PRIOR ART
FIGS. 1*a*, 1*b*, 2*a*, 2*b* and 3 are diagrams for illustrating the magnitude of vertical needle travel and the encounter distance accompanying the rotation of the arm shaft and the loop taker in the prior art sewing machine.
FIGS. 4 and 5 are diagrams similar to FIGS. 1*a*, 1*b*, 2*a*, 2*b* and 3 and illustrating the upward movement magnitude of the needle and the encounter distance in the inventive sewing machine.

It is to be noted that the present invention is not limited to the respective embodiments, and various modifications thereof may be made without departing from the purpose of the invention.

DESCRIPTION OF THE PREFERRED EMBODIMENT

Reference is made to FIGS. 6 through 11 showing the inventive industrial lock stitch buttonhole sewing machine, which is a zig zag sewing machine comprising a frame 1 with a bed 2 having a fabric support surface, a standard 3 and an arm 4, with a recess 3*a* being provided towards the right side of the standard 3 to permit the fabric to be transferred towards the rear on the fabric support surface. An arm shaft 5, which is also used as the main shaft of the sewing machine, is rotatably supported inside said arm 4 by way of a bearing 6, and carries an idle pulley 7 and a drive pulley 8 at the end thereof located towards the standard 3. A belt 9 is placed between the idle pulley 7 and a drive source such as a motor, and the arrangement is so made that, when the belt 9 is shifted from its position on the drive pulley 8, the arm shaft 5 makes a clockwise rotation when seen from the head side of said arm 4 or from the left side of FIG. 7.

Figure 6:
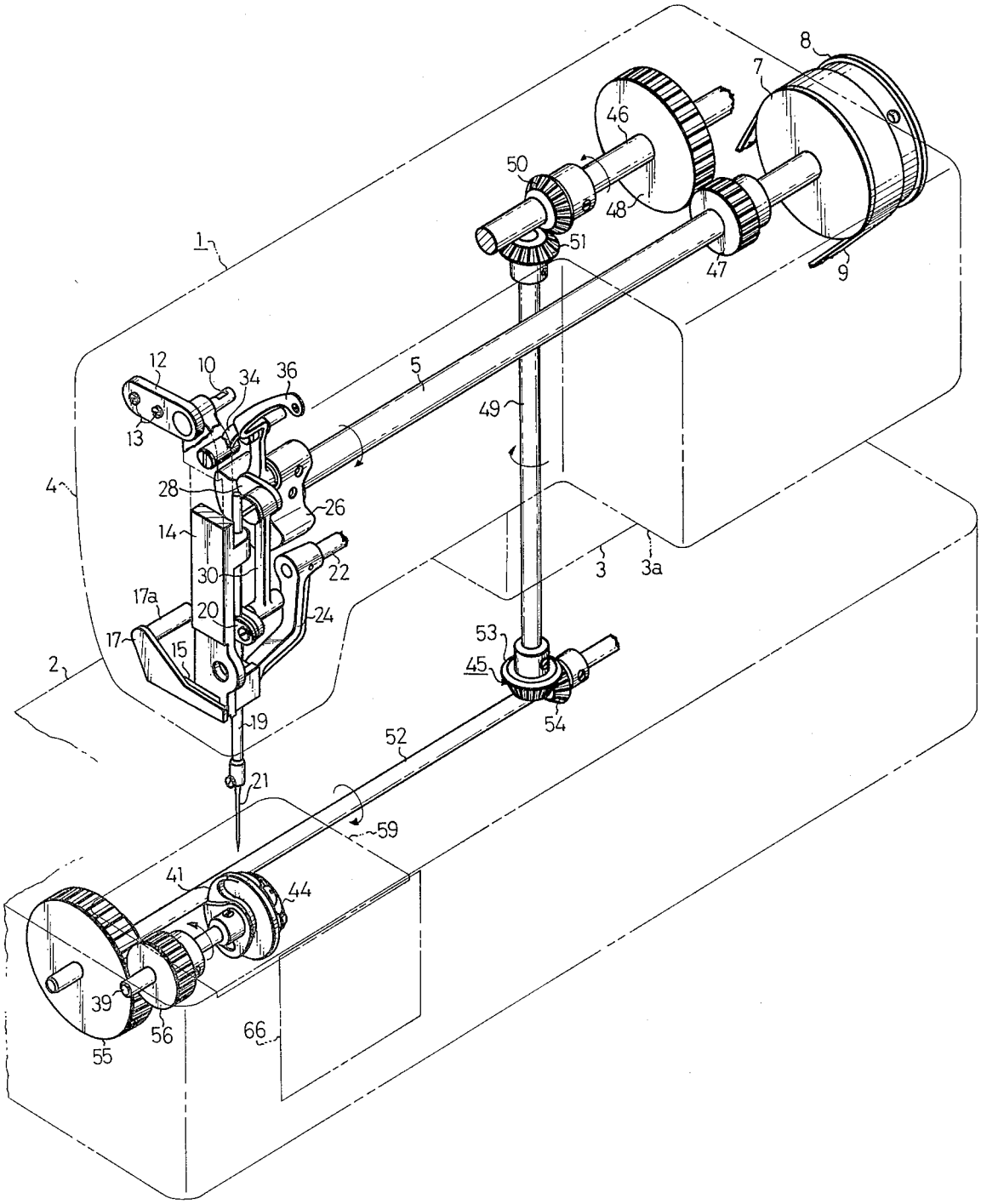
FIG. 6 is a perspective view showing substantial parts of the industrial lock stitch buttonhole sewing machine embodying the present invention.
Figure 7:
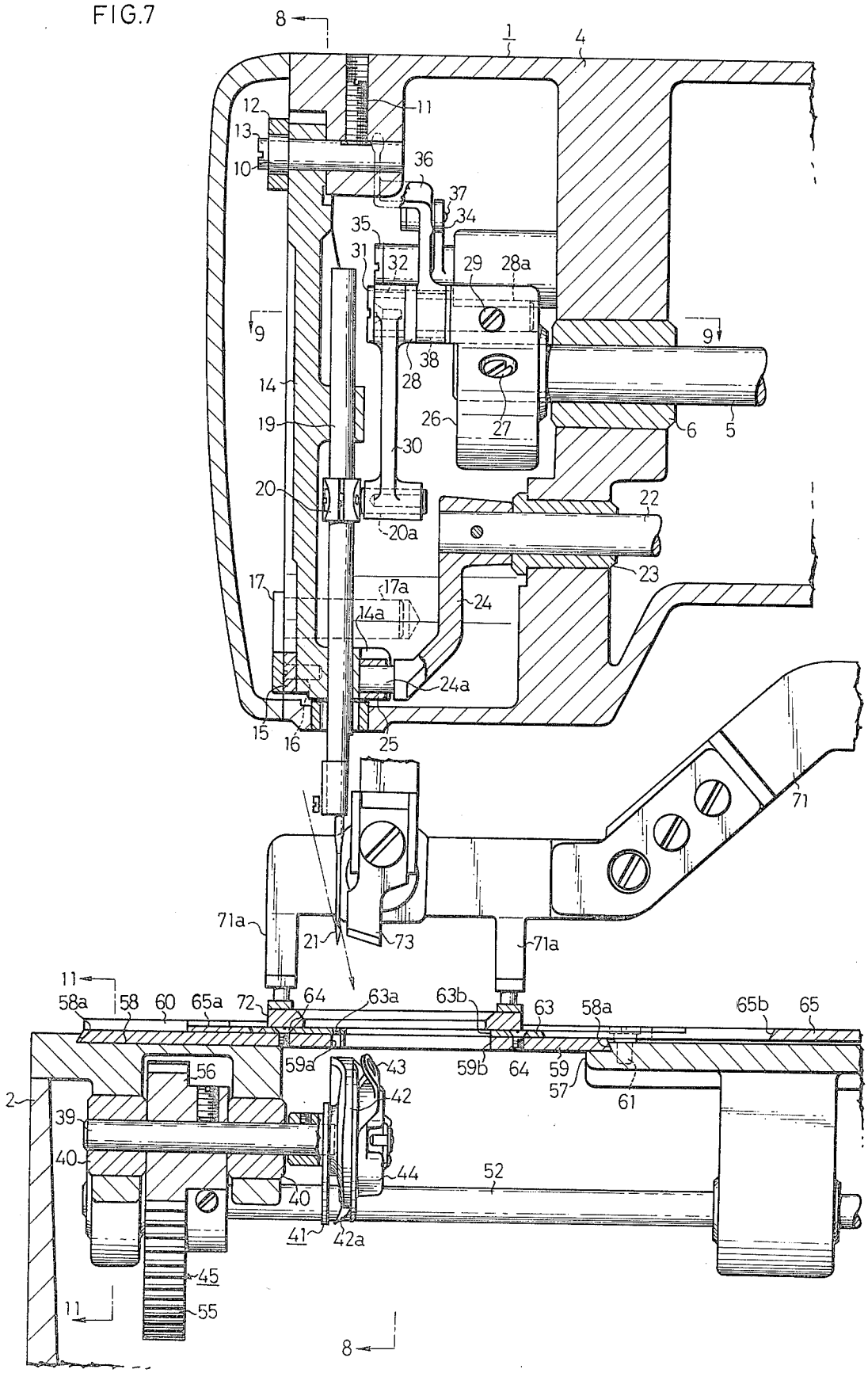
FIG. 7 is a partial side elevation thereof on an enlarged scale.
Figure 8:
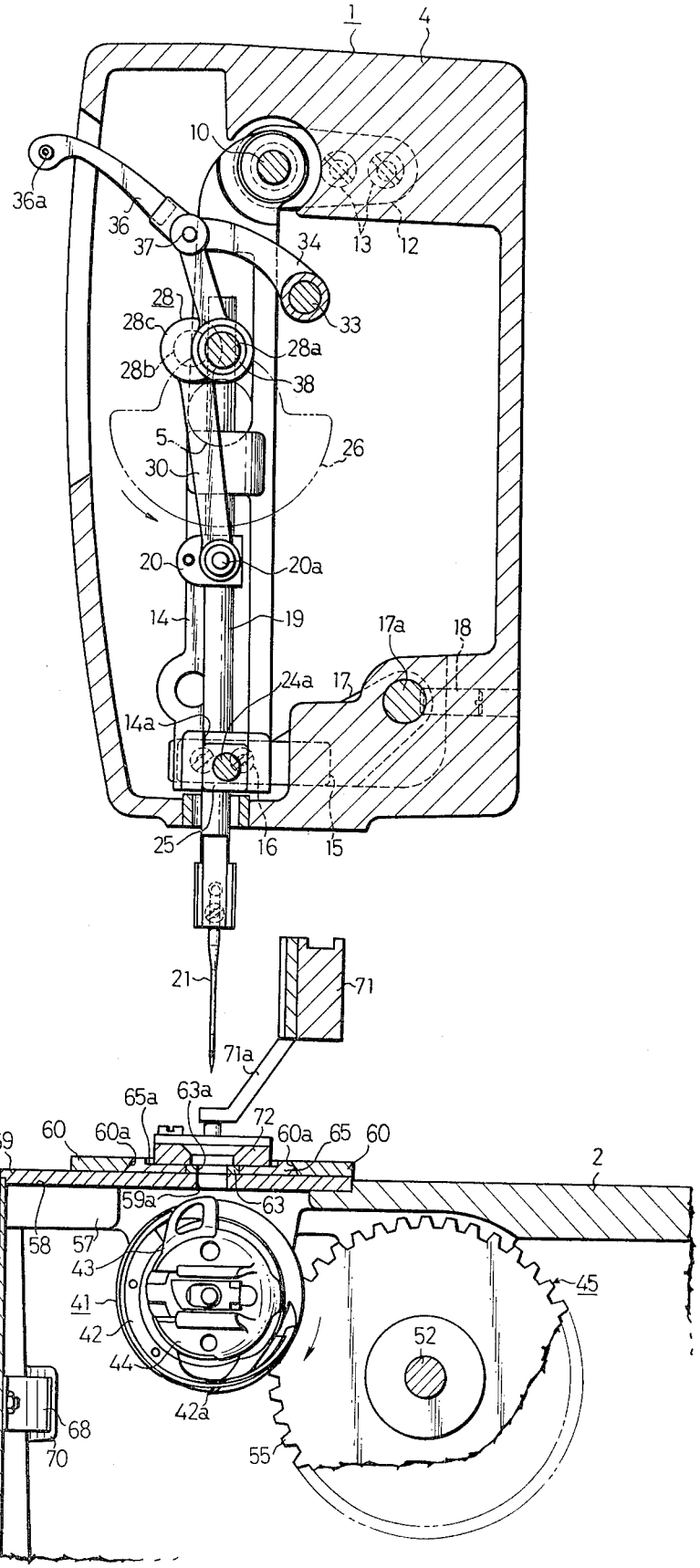
FIG. 8 is a partial section taken along the line 8—8 of FIG. 7.

As shown in FIGS. 6 through 8, a supporting pin 10 is introduced, at one end, into a corresponding hole in the front portion of the arm 4 and is secured by a screw 11. A supporting plate 12 is mounted to the front surface of the arm 4 with two screws 13 for supporting the other end of the supporting pin 10. A needle bar gate 14 is mounted at the upper end to said supporting pin 10, so as to perform an oscillating movement in the left and right direction when seen from the head side of the arm 4. A vertical groove 14*a* is formed at the lower rear surface of the gate 14. An engaging plate 15 is mounted to the lower front portion of the gate 14 by two screws 16. A guide plate 17 has its base end pin 17*a* introduced into a corresponding hole in the front portion of the arm 4 and secured by a screw 18, and abuts on the plate 15 at the free end for guiding the oscillating movement of the gate 14.

A needle bar 19 is carried for vertical movement by the rear portion of the gate 14 and a needle bar holder 20 having a pin 20*a* is secured to about the mid portion of the needle bar 19. A needle 21 is mounted to the lower end of the bar 19 and has a thread aperture through which an upper thread may be passed from the head side of the arm 4 towards the rear as schematically illustrated in FIG. 7. An oscillating shaft 22 is rotatably carried inside the arm 4 by bearing 23 so as to extend below and parallel to said arm shaft 5 and is designed to reciprocatingly rotate about its own axis with rotation of the shaft 5 and by the medium of a suitable zig zag motion generating mechanism (not shown). An oscillating arm 24 is secured at its upper end to said oscillating shaft 22 and has at the lower front end an integral pin 24*a* to which is fitted a sliding block 25 received in turn in a groove 14*a* in the needle bar gate 14. With reciprocating rotation of the shaft 22, the needle bar gate 14 may be oscillated with a design amplitude towards left and right.

Figure 9:
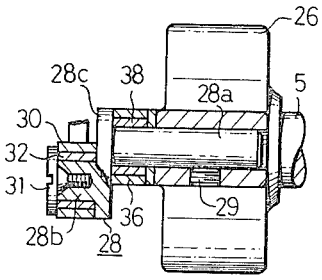
FIG. 9 is a partial section taken along the line 9—9 of FIG. 7.

A crank member 26 is secured by means of a screw 27 to the front end of the arm shaft 5, that is, to the end thereof located towards the head side of the arm 4. As shown in FIGS. 7 and 9, a crank pin 28 consists of a pair of shaft portions 28*a*, 28*b* and a connecting plate portion 28*c* with the rear shaft portion 28*a* being secured by screw 29 to the front surface of the crank member 26 so that the shaft portions 28*a* and 28*b* may extend parallel to the arm shaft 5. A crank rod 30 has its upper end rotatably mounted by a headed screw 31 to the front shaft portion 28*b* of the crank pin 28 by way of a bearing 32, while a pin 20*a* integral with said needle bar holder 20 is received in a corresponding hole in the lower end of the crank rod 30. With the above arrangement, the needle bar 19 may be moved up and down reciprocatingly upon the clockwise rotation of said arm shaft 5.

As shown in FIGS. 6 and 7, a bed shaft 39 is rotatably mounted within the hollow space of the bed 2 of the frame 1 by a pair of bearings 40 and extends parallel to said arm shaft 5 and towards the front side, i.e., the bed shaft 39 and the opposite arm shaft 5 extend in opposite directions from the vertical reciprocating path of the needle 21. A loop taker 41 for zig zag sewing capable of a 360° rotation is mounted to the rear end of said bed shaft 39 at a position corresponding to the reciprocating path of the needle 21 and consists of a loop taker body 42 having a thread seizing rotary hook 42*a*, a bobbin case carrier 43 locked for rotation by a carrier lock member (not shown) and a bobbin case 44 mounted inside said carrier 43 and having a bobbin (not shown). Gear connection means 45 are provided between the bed shaft 39 mounting the loop taker 41 and the arm shaft 5 to serve as drive means for the bed shaft 39. The arrangement is so made that, with continued rotation of the arm shaft 5, the bed shaft 39 is rotated at a rotational speed twice as high as the rotational speed of the arm shaft 5 by way of said gear connection means 45. As shown by the arrow mark of FIG. 6, the loop taker body 42 of said loop taker 41 is rotated counterclockwise or in an opposite direction to the rotation of the arm shaft 5 when seen from the side of the crank member 26 of the arm shaft 5 with the thread seizing rotary hook 42*a* seizing an upper thread loop carried by the needle 21.

As also shown in FIG. 7, the bed shaft 39 and the thread seizing rotary hook 42*a* of the loop taker body 42 of the loop taker 41 are positioned on opposite sides of the reciprocating path of the needle 21.

Such arrangement of the loop taker 41 has been used previously in industrial loop stitch buttonhole sewing machines and high speed zig zag sewing machines. Since the upper and lower threads are arranged on the same side with respect to the needle 21, the stitches formed thereby will be necessarily perfect stitches.

The loop taker 41 of the present invention is known per se but has a novel arrangement of the various component parts thereof.

Next, reference is made to FIG. 6 for explaining the arrangement of the gear connection means 45 in more detail. An intermediate shaft 46 is mounted for rotation within the hollow space of the arm 4 laterally of the arm shaft 5 and is rotated in the direction of the arrow shown in FIG. 6 by way of spur gears 47 and 48 upon rotation of said arm shaft 5. A vertical shaft 49 is mounted within the hollow inner space of the standard 3 for rotation about its vertical axis and is rotated in the direction of the arrow shown in FIG. 6 by way of bevel gears 50 and 51 upon rotation of said intermediate shaft 46. A horizontal shaft 52 is mounted for rotation inside the hollow space of the bed 2 so as to extend parallel to and laterally of said bed shaft 39, and is rotated in the direction of the arrow shown in FIG. 6 by way of bevel gears 53 and 54 upon rotation of said vertical shaft 49. A pair of spur gears 55 and 56 are secured to the front part of the shafts 52 and 39, respectively, for meshing with each other and, upon the rotation of said horizontal shaft 52, the bed shaft 39 is rotated counterclockwise through the medium of these spur gears 55 and 56 as indicated by the arrow mark of FIG. 6.

Figure 11:
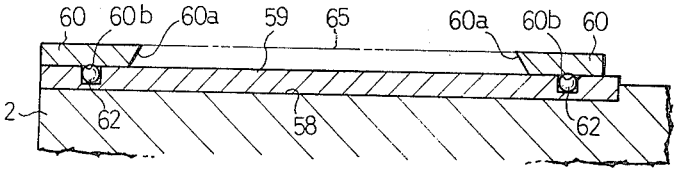
FIG. 11 is a partial enlarged section taken along the line 11—11 of FIG. 7.
Figure 10:
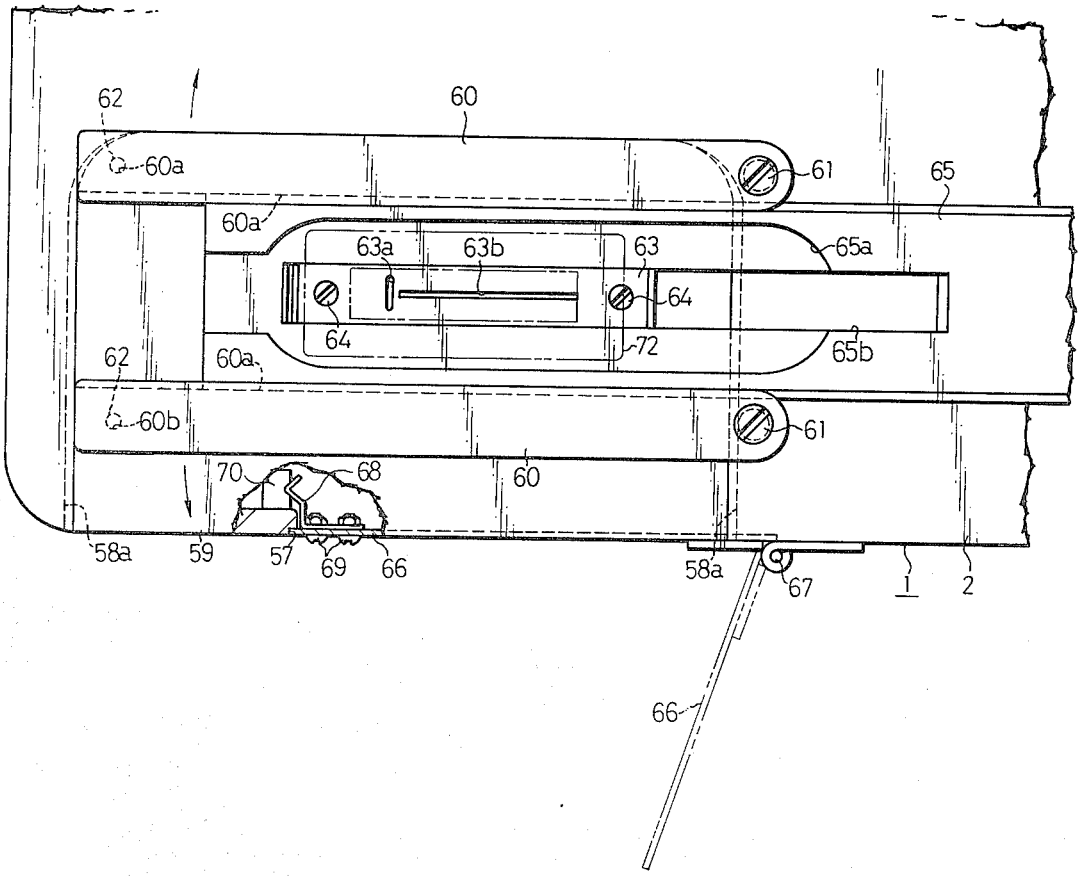
FIG. 10 is a partial plan view showing a fabric feed device mounted on the machine bed.

Next, reference is made to FIGS. 7, 8, 10 and 11 for explanation of the fabric feed means mounted on the bed 2 of the frame 1. An opening 57 is formed in the upper wall towards the right hand wall of the bed 2 at a position corresponding to the loop taker 41 and is defined by a supporting recess 58 having dovetail grooves 58*a* along front and back as well as lateral sides thereof. A needle plate base 59 is fitted into said recess 58 so as to be extracted from the right side along said dovetail groove 58*a* and has, at about the mid portion thereof, a transversely extending needle aperture 59*a* and a longitudinally extending cutter aperture 59*b*. A pair of resilient presser plates 60 are swingably mounted at the rear ends thereof on the upper surface of the bed 2 at a predetermined spacing by stepped screws 61 and, as shown in FIGS. 8 and 11, the inner edges thereof facing towards each other are formed with inclined surfaces 60*a*, while the front lower surfaces thereof are formed with stepped portions 60*b*. A pair of engaging balls 62 are housed under pressure within recesses on the upper surface of the needle plate base 59 and engaged in the stepped portions 60*b* of the presser plates 60 for holding these presser plates in their parallel position as shown in FIG. 10. The needle plate base 59 is held under pressure by the presser plates 60 and restrained from being extracted laterally of the supporting recess 58.

A lengthy needle plate 63 is secured to the upper surface of the needle plate base 59 by two screws 64 so as to extend longitudinally between the two presser plates 60, and is provided with a transversely extending needle aperture 63*a* and a longitudinally extending cutter aperture 63*b* that are coincident respectively with the needle aperture 59*a* and cutter aperture 59*b* of the needle plate base 59. A feed plate 65 is carried for longitudinal movement on the upper surface of the bed 2 as it is held between the inclined surfaces 60*a* of the presser plates 60 and, as shown in FIGS. 7, 8 and 10, the upper surface of the feed plate 65 is formed with a substantially oval recess 65*a* and a lengthy aperture 65*b* for snugly receiving the needle plate 63.

A cover plate 66 is pivotally mounted by a hinge 67 to a side having the opening 57 of the bed 2 for covering said side and is adapted to engage the right hand extremity of the needle plate base 59 when the cover plate 66 is brought to its closure position, as shown in FIGS. 8 and 10. A resilient latch plate 68 is mounted to the front inner surface of the cover plate 66 by a pair of screws 69 and adapted to engage with a latch portion 70 mounted inside the bed 2 for holding the cover plate 66 in the closure position. Thus, by opening the cover plate 66, swinging the presser plates 60 in the direction of the arrows shown in FIG. 10 and thus transversely away from the upper surface of the needle plate base 59, and extracting the needle plate base 59 towards the right while the front portion of the feed plate 65 is lifted manually against the resilience thereof, the opening 57 of the bed 2 may be exposed and hence the mounting position of the loop taker 41 in regard to the bed shaft 39 may be adjusted through the opening 57 to facilitate adjustment of the state of encounter of the loop taker 41 with the needle 21.

As shown in FIG. 7 and 8, a feed arm 71 is supported at the base end on said feed plate 65 with the free end portion thereof extending forwardly between the bed 2 and the arm 4 and carrying at the lower foremost end thereof a pair of projecting leg portions 71*a*. A presser foot 72 in the form of a rectangular frame is swingably supported by the leg portion 71*a* of the feed arm 71 at a position corresponding to the recess 65*a* of the feed plate 65 for clamping the fabric between it and the feed plate 65. The arrangement is so made that feed cam means (not shown), driven with the arm shaft 5, acts for reciprocating said feed plate 65 and the feed arm 71 to feed the fabric and perform buttonhole stitching by cooperation with the needle 21 and the loop taker 41. A cutter 73 is mounted for vertical movement above the bed 2 and in registry with the cutter aperture 63*b* of the needle plate 63 and is designed to descend upon completion of a stitching operation to cut a buttonhole through the fabric.

The operation of the sewing machine so far shown and described is as follows.

When the belt 9 is shifted to the position on the drive pulley 8 by e.g. foot pressure on the start pedal and the arm shaft 5 is driven into actuation, the crank member 26 is rotated clockwise when seen from the head side of the arm 4 as indicated by the arrow shown in FIG. 6. The needle bar 19 may thus be moved up and down through the crank pin 28, crank rod 30 and needle bar holder 20. Furthermore, upon rotation of the arm shaft 5, the oscillating shaft 22 is driven into reciprocating rotation for oscillating the arm 24 and hence the needle bar gate 14 is reciprocated transversely, that is towards the left and right by way of the pin 24*a* and the sliding block 25. Thus the needle 21 mounted to the lower end of the needle bar 19 is moved up and down as it is oscillated with a predetermined amplitude.

On the other hand, upon the clockwise rotation of the crank member 26, the thread take up lever 36 is oscillated up and down through the operation of the crank pin 28 and the link 34. Furthermore, upon rotation of the arm shaft 5, the loop taker 41 mounted to the rear end of the bed shaft 39, is rotated counterclockwise or in an opposite direction to the rotation of the crank member 26 as seen from the head side of the arm 4, through the gear connection means 45, as indicated by the arrow shown in FIG. 6, the thread seizing rotary hook 42*a* of the loop taker 41 thus seizing the upper thread loop carried by the needle 21.

Thus, the upward movement of the needle 21 from its lower dead point at an encounter point thereof with the rotary hook 42*a* of the loop taker 41 and the encounter distance between the rotary hook 42*a* and the thread aperture of the needle 21 at said encounter point remain substantially the same irrespective of whether the needle bar 19 is at the left or right hand position or at the center of the oscillation amplitude when the needle bar 19 is being raised. Hence the upper thread loop held by the needle 21 may be positively seized by the rotary hook 42*a* of the loop taker 41 and thus uniform buttonhole stitches may be formed on the fabric without any skipping of stitches.

Reference is made again to FIGS. 4 and 5 for an explanation of the status of encounter of the needle 21 and the loop taker 41. As the arm shaft and the loop taker are rotated in opposite directions to each other, supposing that the needle bar is being raised as it is swung towards the left with an amplitude l3 equal to 3 mm, as shown in FIG. 4, the angle $\beta 1$ which the crank rod makes with a straight line drawn from the upper pivot axis of the crank rod and which is reached when the arm shaft has been turned through an angle $\theta$ 3 or ($\theta 1+/2$) is larger than the angle $\beta 2$ shown in FIG. 2*b*. Thus the upward movement of the needle is larger than that of the case of FIG. 2*b*. Supposing that the needle bar is being raised as it is swung towards the right with an amplitude l3 equal to 3 mm, as shown in FIG. 5, the angle $\beta 1$ that is reached when the arm shaft has reached an angle $\theta$ 2 or ($\theta$ $-/2$) as shown in FIG. 5 becomes smaller than the angle $\theta$ 2 shown in FIG. 3. Thus the upward movement of the needle is smaller than that of the case of FIG. 2*b*.

The following Table 2 shows the upward movement of the needle and the encounter distance of the loop taker and needle as obtained under the same conditions as FIGS. 1 through 3 except for reversed rotational direction of the loop taker, with the needle being raised in its central position and in the left and right hand positions. Said upward movement of the needle is construed as meaning the upward movement wherein the needle vertically moves from the lowest portion to the position at which the thread seizing rotary hook encounters the center line of the needle, and said encounter distance is construed as meaning the distance between the thread seizing rotary hook of the loop taker and the top end of a thread aperture of the needle at which the thread seizing rotary hook encounters the center line of the needle.

It may be seen from this Table that no appreciable difference may be caused in the magnitude of the upward movement and the encounter distance whether the needle bar has been raised in its left hand or right hand position or in its central position.

TABLE 2

| | Needle Bar Position | | |
|---|---|---|---|
| | Left Hand | Center | Right Hand |
| Upper Movement Magnitude (mm) | 2.74 | 2.5 | 2.27 |
| Encounter Distance (mm) | 1.47 | 2.0 | 1.94 |

Figure 12:
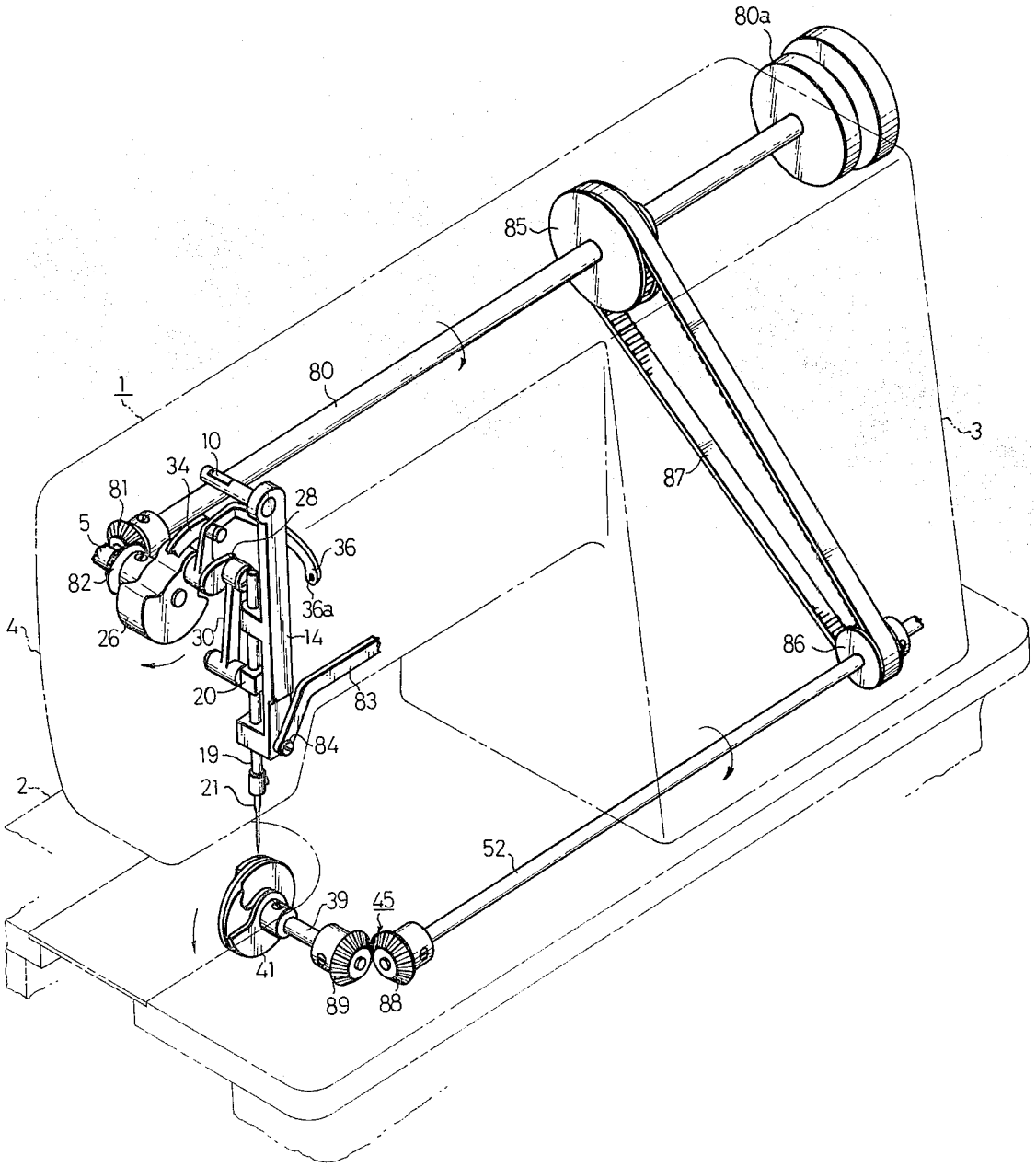
FIG. 12 is a perspective view showing substantial parts of the high speed zig zag sewing machine according to a modified embodiment of the present invention.

Next, reference is made to FIG. 12 for explanation of a modified embodiment of the invention as applied to a high speed zig zag sewing machine. The machine of this embodiment is normally used with the standard 3 of the frame 1 located towards the right and the head end of the arm 4 towards the left. In this Figure, parts or components equivalent to those of the preceding embodiment are shown by the same reference characters and description of these parts or components will be omitted. Thus the following description will be made of those parts or components which are not used in or are different from the preceding embodiment.

In this embodiment, a main shaft 80 is rotatably mounted within the hollow inner space of the arm 4 of the frame 1 and has a pulley 80*a* secured to the right hand extremity thereof, said pulley being connected in turn to a motor or like drive means (not shown) by way of a transmission belt (also not shown). An arm shaft 5 is rotatably mounted within the hollow space of the head portion of the arm 4 so as to extend transversely and at right angles to the axis of the main shaft 80. A crank member 26 is secured to the foremost part of the arm shaft 5. A pair of bevel gears 81 and 82 are secured respectively to the left hand extremity of the main shaft 80 and to the rear end of the arm shaft 5 for meshing with each other so that, when the main shaft 80 makes a clockwise rotation by said drive source, as seen from the head end of the arm 4, the arm shaft 5 makes a clockwise rotation as seen from the end of the crank member 26 through bevel gears 81 and 82. Thus, upon rotation of arm shaft 5, the needle bar 19 carried by the needle bar gate 14 is vertically reciprocated through cooperation of the crank member 26 and the crank pin 28, at the same time that a thread take up lever 36 which is flat and substantially L-shaped and projects forwardly of the arm 4 is swung vertically through cooperation of the crank member 26, crank pin 28 and link 34.

A rod 83 is mounted at one end to the gate 14 by a stepped screw 84 and connected at the other end to a zig zag motion generating mechanism (not shown), the arrangement being such that the needle bar gate 14 may be reciprocated towards the left and right upon rotation of the main shaft 80. A bed shaft 39 is mounted rotatably in the hollow space of the bed 2 of the frame 1 so as to extend parallel to the arm shaft 5 and forwardly in an opposite direction to the arm shaft 5 with respect to a point corresponding to the needle 21. The rear end of shaft 39 carries a loop taker 41 for zig zag sewing that is similar to the one used in the preceding embodiment and capable of a 360° rotation. Gear connection means 45 is provided between the main shaft 80 and the bed shaft 39. Said means 45 comprises a horizontal shaft 52 rotatably mounted in the hollow space of the bed 2, pulleys 85 and 86 mounted respectively on the main shaft 80 and the horizontal shaft 52, a timing belt 87 placed between said pulleys 85 and 86 and, bevel gears 88 and 89 secured respectively to the corresponding ends of shafts 52 and 39, the arrangement being such that the loop taker 41 is rotated by gear connection means 45 counterclockwise as seen from the crank member side of the arm shaft 5.

Thus, in the sewing machine of the present embodiment, no appreciable difference is caused in the upward movement magnitude of the needle 31 as measured from the lower dead point of the needle 21 to the point of encounter with the beak of loop taker 41 and in the encounter distance as measured from the rotary hook to the thread aperture of the needle 21 at said encounter point, whether the needle bar 19 is raised as it is swung towards the left or right of the amplitude of oscillation as shown in FIGS. 4 and 5, or the needle bar is raised as it is in the central position. The upper thread loop carried by the needle 21 is thus positively seized by the rotary hook of the loop taker 41 for providing uniform zig zag stitches on the fabric without stitch skipping.

What is claimed is:

1. A zig zag sewing machine comprising;

a frame including an arm and a bed, an arm shaft rotatably supported on said arm and having a crank member at one end, said arm shaft being rotatable in the clockwise direction as seen from said crank member end thereof, a needle bar operatively connected with said crank member through a crank rod for reciprocating motion, a needle supported on said needle bar, means for effecting lateral movement of said needle bar in a plane perpendicular to the axis of said arm shaft, a bed shaft rotatably supported on said bed in parallel with said arm shaft, said bed shaft and said arm shaft extending in opposite directions from the reciprocating path of said needle, and a loop taker including a loop seizing beak and secured to the bed shaft at said corresponding position, said loop taker being rotated synchronously with and in an opposite direction to the rotation of said arm shaft, said loop seizing beak of the loop taker and said bed shaft being positioned on opposite sides of the reciprocating path of said needle.

2. A zig zag sewing machine according to claim 1 which further comprises a link type thread take up mechanism including a thread take up lever having a lower end pivotally connected with said crank member and an upper end projecting from said arm, said upper end of the thread take up lever having a thread aperture, and a link pivotally connected at one end thereof with said arm and pivotally connected at the other end thereof with the intermediate portion of said thread take up lever.

3. A zig zag sewing machine according to claim 2 wherein said upper end of the thread take up lever projects from the right side of said arm as seen from the crank member end of said arm shaft.

4. A zig zag sewing machine comprising;

a frame including an arm and a bed, an arm shaft rotatably supported on said arm and extending in the longitudinal direction of said arm, said arm shaft having a crank member at one end, said arm shaft being rotatable in the clockwise direction as seen from said crank member end thereof, a needle bar operatively connected with said crank member through a crank rod for reciprocating motion, a needle supported on said needle bar, means for effecting lateral movement of said needle bar in a plane perpendicular to the axis of said arm shaft, a bed shaft rotatably supported on said bed in parallel with said arm shaft, said bed shaft and said arm shaft extending in opposite directions from the reciprocating path of said needle, a loop taker including a loop seizing beak and secured to the bed shaft at said corresponding position, said loop taker being rotated synchronously with and in an opposite direction to the rotation of said arm shaft, said loop seizing beak of the loop taker and said bed shaft being positioned on opposite sides of the reciprocating path of said needle, and a work holder disposed on said bed and movable in the longitudinal direction of said arm.

5. A zig zag sewing machine comprising;

a frame including an arm and a bed, a main shaft rotatably supported on said arm and extending in the longitudinal direction of said arm, an arm shaft rotatably supported on said arm and extending along the horizontal axis perpendicular to the axis of said main shaft, said arm shaft being drivingly connected with said main shaft at one end and having a crank member at the other end, said arm shaft being rotatable in the clockwise direction as seen from said crank member end thereof, a needle bar operatively connected with said crank member through a crank rod for reciprocating motion, a needle supported on said needle bar, means for effecting lateral movement of said needle bar in a plane perpendicular to the axis of said arm shaft, a bed shaft rotatably supported on said bed in parallel with said arm shaft, said bed shaft and said arm shaft extending in opposite directions from the reciprocating path of said needle, motion transmitting means provided between said main shaft and said bed shaft, and a loop taker including a loop seizing beak and secured to the bed shaft at said corresponding position, said loop taker being rotated with and in an opposite direction to the rotation of said arm shaft through said motion transmitting means according to the rotation of said main shaft, said loop seizing beak of the loop taker and said bed shaft being positioned on opposite sides of the reciprocating path of said needle.

* * * * *